US011442392B2

(12) United States Patent
Okumura

(10) Patent No.: US 11,442,392 B2
(45) Date of Patent: Sep. 13, 2022

(54) POST-PROCESSING DEVICE AND IMAGE FORMING SYSTEM

(71) Applicant: KYOCERA Document Solutions Inc., Osaka (JP)

(72) Inventor: Takayuki Okumura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 188 days.

(21) Appl. No.: 16/930,787

(22) Filed: Jul. 16, 2020

(65) Prior Publication Data

US 2021/0026286 A1 Jan. 28, 2021

(30) Foreign Application Priority Data

Jul. 22, 2019 (JP) ..... JP2019-134812

(51) Int. Cl.
*G03G 15/00* (2006.01)
*B65H 37/04* (2006.01)

(52) U.S. Cl.
CPC ..... *G03G 15/6544* (2013.01); *B65H 37/04* (2013.01); *G03G 15/5016* (2013.01); *G03G 15/607* (2013.01); *G03G 15/6552* (2013.01); *G03G 15/6573* (2013.01); *B65H 2511/11* (2013.01); *B65H 2511/12* (2013.01); *B65H 2801/27* (2013.01); *G03G 2215/00421* (2013.01); *G03G 2215/00734* (2013.01); *G03G 2215/00827* (2013.01)

(58) Field of Classification Search
CPC ..... G03G 15/6544; G03G 15/5016; G03G 15/607; G03G 15/6552; G03G 15/6573; G03G 2215/00421; G03G 2215/00734; G03G 2215/00827; B65H 37/04; B65H 2511/11; B65H 2511/12; B65H 2801/27
See application file for complete search history.

(56) References Cited

U.S. PATENT DOCUMENTS 9,944,488 B2 4/2018 Kunieda et al.
2008/0315514 A1* 12/2008 Iguchi ..... B65H 29/52 271/270

(Continued)

FOREIGN PATENT DOCUMENTS

JP 2016-216227 A 12/2016

*Primary Examiner* — David H Banh
(74) *Attorney, Agent, or Firm* — Studebaker & Brackett PC

(57) ABSTRACT

An image forming system includes an image forming apparatus and a post-processing device. The image forming apparatus includes a scanner reading image data from a sheet, an image forming part forming an image on the sheet, and a sheet ejecting part ejecting the sheet after forming the image. The post-processing device includes a post-processing conveying path, and a stapling part. The post-processing conveying path introduces the sheet from the sheet ejecting part and conveys the sheet. The stapling part collects sheets conveyed on the post-processing conveying path for each predetermined number of sheets and executes staple processing to the sheets. The image forming apparatus or the post-processing device includes a size deciding part deciding a sheet size based on the image data. The post-processing device includes a staple controlling part determining a binding position for the staple processing on the basis of the sheet size.

13 Claims, 5 Drawing Sheets

(56) References Cited

U.S. PATENT DOCUMENTS

| | | | | |
|---|---|---|---|---|
| 2009/0226230 | A1* | 9/2009 | Ohkawa | G03G 15/6544 399/408 |
| 2010/0027055 | A1* | 2/2010 | Mori | H04N 1/32496 358/1.15 |
| 2010/0149589 | A1* | 6/2010 | Hayashi | H04N 1/00503 358/1.15 |
| 2011/0215515 | A1* | 9/2011 | Soga | B65H 9/00 270/58.08 |
| 2011/0236040 | A1* | 9/2011 | Tanaka | G03G 15/5029 399/21 |
| 2017/0341889 | A1* | 11/2017 | Kikuta | B65H 1/04 |
| 2018/0072084 | A1* | 3/2018 | Shimizu | B65H 31/3036 |
| 2020/0391472 | A1* | 12/2020 | Suzuki | B31F 1/07 |

* cited by examiner

POST-PROCESSING DEVICE AND IMAGE FORMING SYSTEM

INCORPORATION BY REFERENCE

This application is based on and claims the benefit of priority from Japanese Patent application No. 2019-134812 filed on Jul. 22, 2019, the entire contents of which are incorporated herein by reference.

BACKGROUND

The present disclosure relates to a post-processing device executing post-processing to a sheet ejected from an image forming apparatus, and an image forming system including the image forming apparatus.

An image forming apparatus, such as a multifunction peripheral or a printer, forms an image on a sheet and eject the sheet, and a post-processing device introduces the sheet ejected from the image forming apparatus and executes post-processing, such as punch processing or staple processing, to the sheet.

For example, the post-processing device includes a first binding part binding a sheet bundle, a second biding part having the number of bindable sheets larger than the first binding part, and a sheet number deciding part deciding whether or not the number of sheets to be bound exceeds the number of bindable sheets of the first binding part. In a case where the sheet number deciding part decides that the number of sheets to be bound exceeds the number of bindable sheets after the first binding part is moved to a binding position, the first binding part is retracted from the binding position. In a case where the sheet number deciding part decides that the number of sheets to be bound exceeds the number of bindable sheets, the second binding part is moved to the binding position.

The image forming apparatus often forms the image on the sheet of a regular size, and the post-processing device executes staple processing to the sheet of the regular size introduced from the image forming apparatus at a predetermined binding position. The image forming apparatus may form the image on the sheet of an irregular size, but the conventional post-processing device cannot grasp a dimension (e.g. a length and a width) of the sheet if introducing the sheet of the irregular size. Moreover, the post-processing device can receive the dimension of the sheet of the irregular size manually inputted by usage of an operation part by a user, but it is feared that the user incorrectly inputs the dimension of the sheet. Therefore, it is impossible to grasp an appropriate binding position of the sheet of the irregular size and to execute appropriate staple processing.

SUMMARY

An image forming system of the present disclosure includes an image forming apparatus forming an image on a sheet, and a post-processing device executing post-processing to the sheet having the image formed by the image forming apparatus. The image forming apparatus includes a scanner, an image forming part, and a sheet ejecting part. The scanner obtains image data by reading the sheet. The image forming part forms the image on the sheet. The sheet ejecting part ejects the sheet having the image formed by the image forming part. The post-processing device includes a post-processing conveying path, and a stapling part. The post-processing conveying path introduces the sheet ejected from the sheet ejecting part and conveys the sheet. The stapling part collects sheets conveyed on the post-processing conveying path for each predetermined number of sheets and executes staple processing to the sheets. The image forming apparatus or the post-processing device further includes a size deciding part deciding a sheet size of the sheet on the basis of the image data obtained by the scanner. The post-processing device further includes a staple controlling part determining a binding position of the sheet directed to the staple processing on the basis of the sheet size decided by the size deciding part.

A post-processing device of the present disclosure includes a post-processing conveying path, a stapling part, a scanner, a size deciding part, and a staple controlling part. The post-processing conveying path conveys a sheet, on which an image is formed, from an image forming apparatus. The stapling part collects sheets conveyed on the post-processing conveying path for each predetermined number of sheets and executes staple processing to the sheets. The scanner is arranged at an upstream side from the stapling part in a conveying direction of the sheet and obtains image data by reading the sheet conveyed on the post-processing conveying path. The size deciding part decides a sheet size of the sheet on the basis of the image data. The staple controlling part determines a binding position of the sheet directed to the staple processing on the basis of the sheet size decided by the size deciding part.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
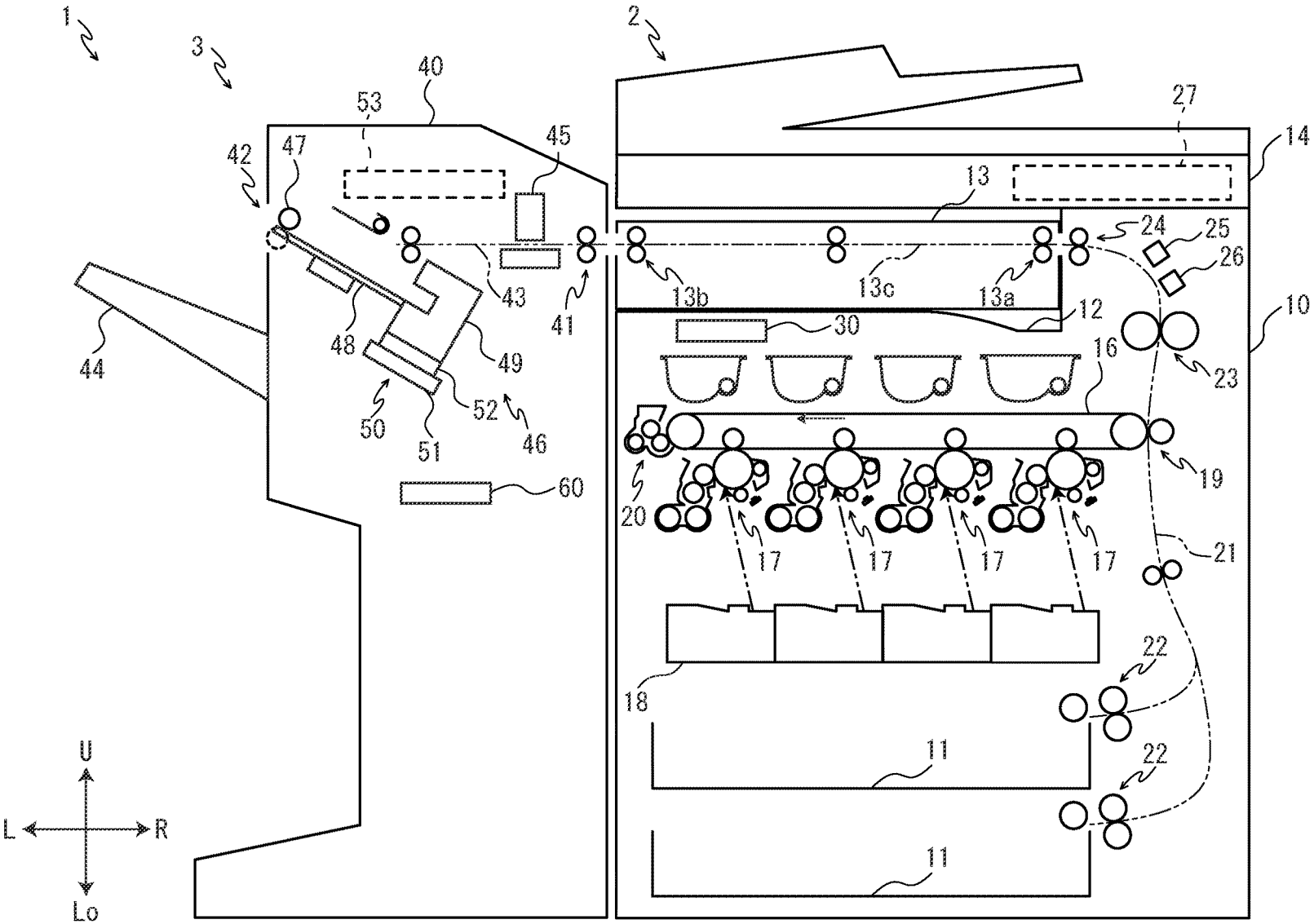
FIG. 1 is a sectional view schematically showing an image forming system according to an embodiment of the present disclosure.

Entire structure of an image forming system 1 according to an embodiment of the present disclosure will be described with reference to FIG. 1. The image forming system 1 includes a multifunction peripheral 2 as an image forming apparatus and a post-processing device 3. Hereinafter, for convenience of description, it will be described so that the front side of the multifunction peripheral 2 is positioned at the near side on a paper sheet of FIG. 1. Arrows L, R, U and Lo in each FIG respectively indicate a left side, a right side, an upper side and a lower side of the multifunction peripheral 2. The post-processing device 3 is attached at the left side of the multifunction peripheral 2.

The multifunction peripheral 2 will be described with reference to FIG. 1. The multifunction peripheral 2 includes a roughly box-formed multifunction peripheral body 10. In a lower part of the multifunction peripheral body 10, a plurality of sheet feeding cartridges 11 storing sheets are provided. In an upper part of the multifunction peripheral body 10, an in-body sheet ejection space is arranged and, in a bottom face constituting the in-body sheet ejection space, an ejected sheet tray 12 on which the sheet having the formed image is ejected is provided. In addition, in the in-body sheet ejection space, a relay unit 13 conveying the sheet between the multifunction peripheral 2 and the post-processing device 3 is provided. At the upper side of the multifunction peripheral body 10, a document reading device 14 including an image reading part and a document feeding part to obtain image data by reading the document is provided.

In a central part of the multifunction peripheral body 10, an intermediate transferring belt 16 as an image carrier is windingly stretched among a plurality of rollers. At a lower side of the intermediate transferring belt 16, four image forming parts 17 forming the image are provided for respective toner colors (for example, four colors of yellow, magenta, cyan and black). At a lower side of the four image forming parts 17, an exposing part 18 is provided. At a right end of the intermediate transferring belt 16, a secondary transferring part 19 is provided and, at a left end of the intermediate transferring belt 16, a cleaning unit 20 for cleaning the intermediate transferring belt 16 is provided. The secondary transferring part 19 is composed of a part at a right end side of the intermediate transferring belt 16 and a secondary transferring roller.

In each image forming part 17, a photosensitive drum as an image carrier is rotatably provided. At the periphery of the photosensitive drum, a charging part, a developing part, a primary transferring part, a static eliminating part and a cleaning part are arranged in a sequential order of electrophotographic process. At an upper side of respective developing parts of the image forming parts 17, toner containers corresponding to the respective image forming parts 17 are provided for the respective toner colors (for example, four colors of yellow, magenta, cyan and black). Each toner container contains the toner of each color.

At a right part in the multifunction peripheral body 10, a conveying path 21 of the sheet is provided and, along the conveying path 21, a plurality of conveying rollers are provided. A conveying direction of the sheet of the conveying path 21 is a length direction of the sheet and an orthogonal direction (forward and backward directions) to the conveying direction is a width direction of the sheet. At an upstream part of the conveying path 21, a plurality of sheet feeding parts 22 are provided for the respective sheet feeding cartridges 11. At a middle stream part of the conveying path 21, the above-described secondary transferring part 19 is provided. At a downstream part of the conveying path 21, a fixing device 23 is provided and, at a downstream end of the conveying path 21, a multifunction peripheral sheet ejecting part 24 (a sheet ejecting part) is provided. Incidentally, the multifunction peripheral sheet ejecting part 24 has an opening at a right face constituting the in-body sheet ejection space.

Moreover, between the fixing part 23 and the multifunction peripheral sheet ejecting part 24, an image scanner 25 (a scanner) is provided in the vicinity of the conveying path 21. In other words, the image scanner 25 is provided at a downstream side from the fixing part 23 in the conveying direction of the sheet on the conveying path 21. In addition, at an upstream side from the image scanner 25 in the conveying direction of the sheet on the conveying path 21, a sheet sensor 26 is provided.

The image scanner 25 is composed of, for example, a line sensor or the like and captures the image of the sheet passing through a predetermined capturing position on the conveying path 21 between the fixing part 23 and the multifunction peripheral sheet ejecting part 24 to obtain the image data from a leading end to a trailing end of the sheet. The sheer sensor 26 detects the sheet introduced to the capturing position of the image scanner 25. Then, at a timing when the sheer sensor 26 detects the sheet, the image scanner 25 is activated to capture the image of the sheet.

Further, in the upper part of the multifunction peripheral body 10, an operation display part 27 (an operation part) is attached at a front side. The operation display part 27 includes, for example, operation keys, such as ten keys, a start key, a system menu key, a transmission key and a copy key, and a display device, such as a touch panel, to receive operation input from a user.

The operation display part 27 receives setting of post-processing (e.g. punch processing of a punching part 45 or staple processing of a stapling part 46) to the sheet after image forming operation in the post-processing device 3. For example, the operation display part 27 receives setting of on or off of staple processing. Moreover, the operation display part 27 receives input of the number of binding to the sheet directed to staple processing. In a case where the user inputs the number of binding, the number of binding of the stapling part 46 is determined by an input value, or in a case where the user does not input the number of binding, the number of binding of the stapling part 46 is determined by a previously predetermined initial value (e.g. 2).

The relay unit 13 will be described. The relay unit 13 includes a relay sheet feeding part 13*a* having an opening at a right end side and a relay sheet ejecting part 13*b* (a sheet ejecting part) having an opening at a left end side. Inside the relay unit 13, a relay conveying path 13*c* conveying the sheet from the relay sheet feeding part 13*a* to the relay sheet ejecting part 13*b* is provided and, along the relay conveying path 13*c*, a plurality of conveying rollers are provided. When the relay unit 13 is attached to the multifunction peripheral body 10, the relay sheet feeding part 13*a* is arranged to a position corresponding to the multifunction peripheral sheet ejecting part 24 of the multifunction peripheral body 10 and the relay sheet ejecting part 13*b* is positioned at a left side face of the multifunction peripheral body 10.

image forming operation of the multifunction peripheral 2 will be described. In the multifunction peripheral 2, image data is inputted from the document reading device 14 or an external computer. In each image forming part 17, the photosensitive drum is electrically charged by the charging part, and then, exposed on the basis of the image data by the exposing part 18, and thereby, an electrostatic latent image is formed on the photosensitive drum. The electrostatic latent image on the photosensitive drum is developed for a toner image of each color by the developing part. The toner image on the photosensitive drum is primarily transferred to a surface of the intermediate transferring belt 16 by the primary transferring part. The four image forming parts 17 sequentially perform the above-described operation, and thereby, a toner image of full color (a color toner image) is formed on the intermediate transferring belt 16. The color toner image is supplied to a secondary transferring part 19 at a predetermined secondary transfer timing by rotation of the intermediate transferring belt 16.

On the other hand, the sheet stored in the sheet feeding cartridge 11 is picked up by the sheet feeding part 22, and then, conveyed on the conveying path 21. Subsequently, the sheet on the conveying path 21 is conveyed to the secondary transferring part 19 at the predetermined secondary transfer timing described above. In the secondary transferring part 19, the color toner image on the intermediate transferring belt 16 is secondarily transferred to the sheet. The sheet having the secondarily transferred color toner image is conveyed to a downstream side on the conveying path 21 and, after the color toner image is fixed to the sheet by the fixing part 23, the sheet is ejected from the multifunction peripheral sheet ejecting part 24 to the in-body sheet ejection space.

At this time, in a case where the relay unit 13 is provided in the in-body sheet ejection space, the sheet is ejected to the relay unit 13 or, in a case where the relay unit 13 is not provided in the in-body sheet ejection space, the sheet is ejected onto the ejected sheet tray 12. The sheet ejected to the relay unit 13 is introduced inside the relay unit 13 via the relay sheet feeding part 13*a* and conveyed to the relay sheet ejecting part 13*b* along the relay conveying path 13*c*. Further, the sheet is ejected from the relay sheet ejecting part 13*b* to the left side of the relay unit 13, that is, ejected toward the post-processing device 3 arranged at the left side of the multifunction peripheral 2.

Figure 2:
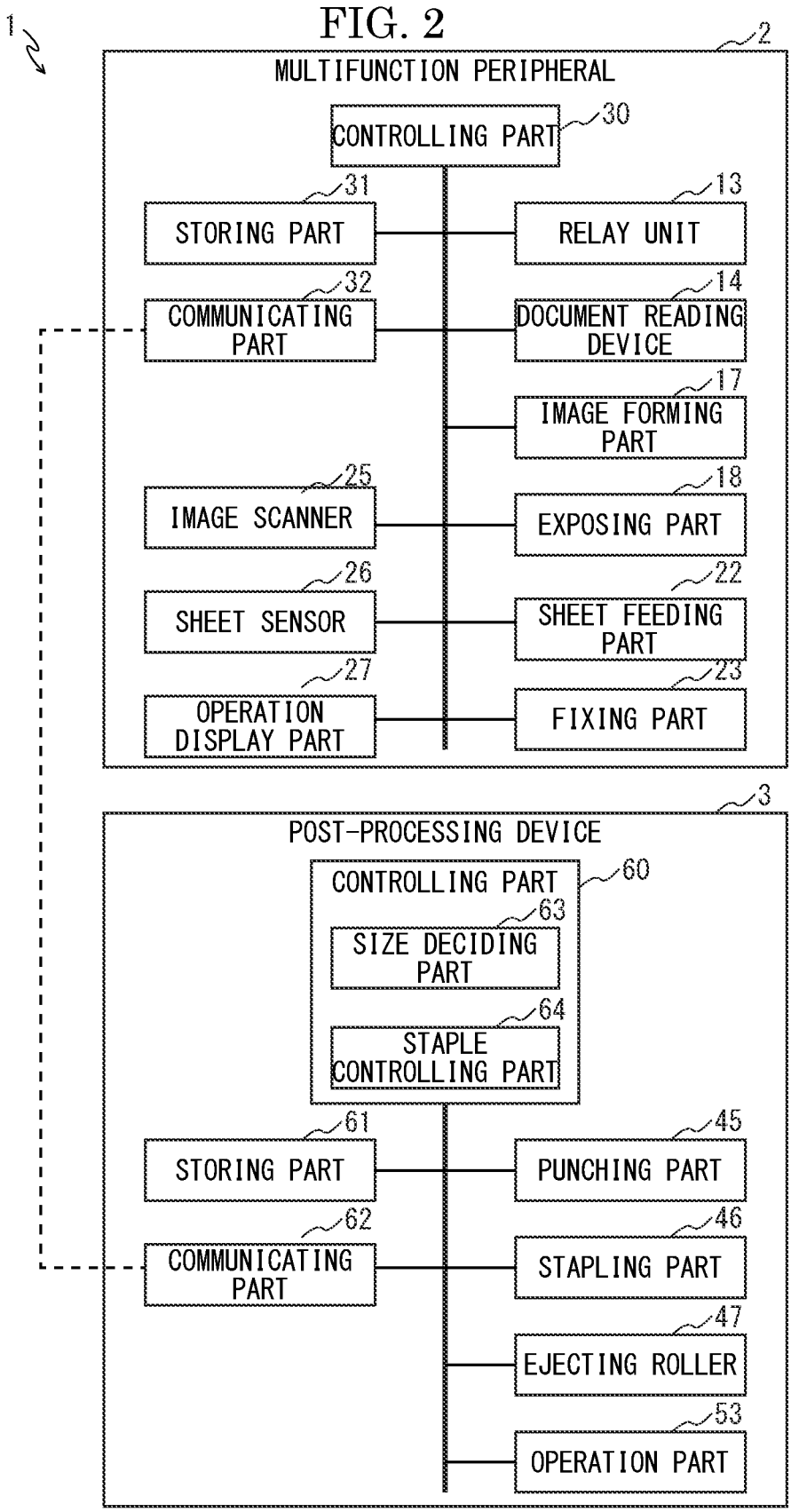
FIG. 2 is a block diagram showing electric structure of the image forming system according to the embodiment of the present disclosure.

Electric structure of the multifunction peripheral 2 will be described with reference to FIG. 2. The multifunction peripheral 2 includes a controlling part 30 composed of a central processing unit (CPU) or the like, and a storing part 31 composed of a ROM, a RAM and others, inside the multifunction peripheral body 10.

The controlling part 30 controls each component connected to the controlling part 30 on the basis of control program and control data stored in the storing part 31. For example, the controlling part 30 is connected to each component of the multifunction peripheral 2, such as the relay unit 13, the document reading device 14, the image forming parts 17, the exposing part 18, sheet feeding parts 22, the fixing part 23, the image scanner 25, the sheet sensor 26, the operation display part 27 and a driving source (not shown) for each conveying roller. Subsequently, the controlling part 30 controls the above-described image forming operation and others.

In addition, the controlling part 30 is connected to a communicating part 32 as an interface communicating with an external device. When the communicating part 32 is connected with the post-processing device 3, the multifunction peripheral 2 and the post-processing device 3 become possible to communicate with each other.

For example, when the multifunction peripheral 2 executes the image forming operation, the controlling part 30 transmits post-processing instruction (e.g. punch processing instruction or staple processing instruction) to the post-processing device 3 via the communicating part 32 so that the post-processing device 3 executes post-processing (e.g. punch processing or staple processing) to the sheet after the image forming operation. Incidentally, staple processing instruction contains information of on or off of staple processing and contains information of a sheet size if the sheet size is a regular size as A3 size, A4 size or the like. In addition, staple processing instruction contains information of the number of binding as the previously predetermined initial value or the number of binding set by the operation display part 27.

Figure 3:
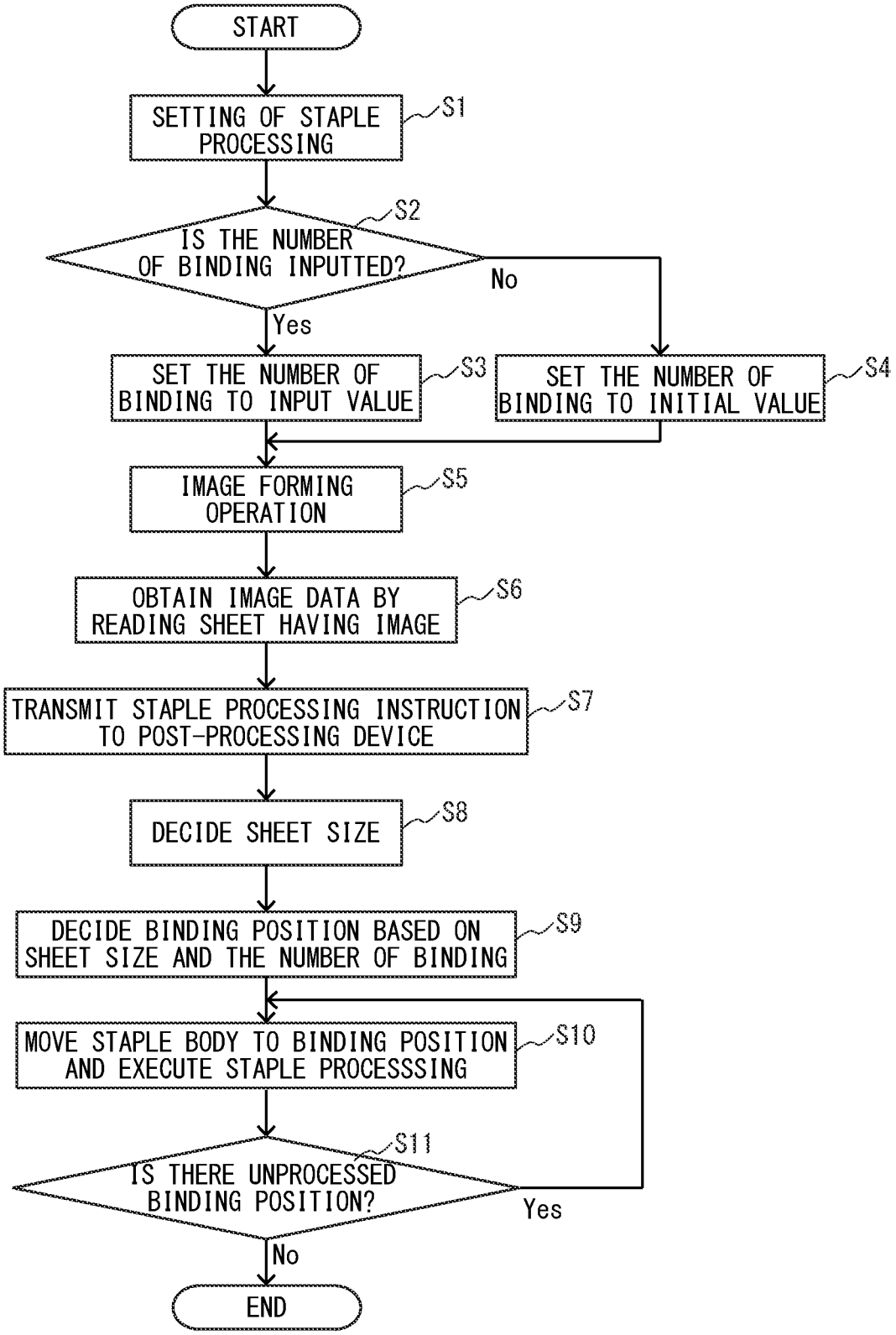
FIG. 3 is a flowchart showing setting operation and executing operation of staple processing in the image forming system according to the embodiment of the present disclosure.

Setting operation of staple processing in the multifunction peripheral 2 will be described with reference to a flowchart in FIG. 3.

First, before executing the image forming operation, such as print or copy, the user manipulates the operation display part 27 to perform setting of staple processing (step S1). At this time, if the number of binding of staple processing is inputted (step S2: Yes), the number of binding is set by the input value (step S3). On the other hand, if the number of binding of staple processing is not inputted (step S2: No), the number of binding is set by the initial value (step S4).

After that, when the user starts the image forming operation (step S5) and the image is formed and fixed on the sheet, the sheet having the fixed image is ejected from the fixing part 23 and conveyed on the conveying path 21. If the sheet sensor 26 detects the sheet conveyed on the conveying path 21, the controlling part 30 starts the image scanner 25 in accordance with a detected result. The image scanner 25 captures the image of the sheet from the leading end to the trailing end in the width direction to create image data and outputs the image data to the controlling part 30 (step S6).

The controlling part 30 transmits staple processing instruction to the post-processing device 3 via the communicating part 32 (step S7), wherein the staple processing instruction contains information of the number of binding set as described above and others and contains the image data created by the image scanner 25.

Next, the post-processing device 3 will be described with reference to FIG. 1. The post-processing device 3 includes a roughly box-formed device body 40. The device body 40 includes a post-processing sheet feeding part 41 having an opening at a right face and a post-processing sheet ejecting part 42 having an opening at a left face.

Inside the device body 40, a post-processing conveying path 43 conveying the sheet from the post-processing sheet feeding part 41 to the post-processing sheet ejecting part 42 is provided and, along the post-processing conveying path 43, a plurality of conveying rollers are provided. A conveying direction of the sheet of the post-processing conveying path 43 is a length direction of the sheet and an orthogonal direction (forward and backward directions) to the conveying direction is a width direction of the sheet. When the post-processing device 3 is attached to left side of the multifunction peripheral body 10, the post-processing sheet feeding part 41 is arranged to a position corresponding to the relay sheet ejecting part 13*b* of the relay unit 13 provided in the in-body sheet ejection space of the multifunction peripheral body 10.

Outside the device body 40, a stack tray 44 on which the sheet ejected from the post-processing sheet ejecting part 42 is stacked is provided so as to protrude from a left side face of the device body 40 to the outside.

Inside the device body 40, along the post-processing conveying path 43, the punching part 45 executing punch processing for punching a punch hole in the sheet and the stapling part 46 executing staple processing for binding the sheets for each predetermined number of sheets are provided. Incidentally, the device body 40 may include a sheet folding part executing fold processing of the sheet or a mechanism having another post-processing function. In addition, inside the device body 40, a pair of sheet ejecting rollers are provided in the vicinity of the post-processing sheet feeding part 41 along the post-processing conveying path 43.

The stapling part 46 includes a processing tray 48, a staple body 49 and a moving mechanism 50.

The processing tray 48 is arranged in the middle of the post-processing conveying path 43 and, on the processing tray 48, the sheets directed to staple processing in the stapling part 46 are temporarily placed for each predetermined number of sheets. The processing tray 48 is inclined upwardly from an upstream side to a downstream side in the conveying direction of the sheet on the post-processing conveying path 43, that is, inclined in an upper left direction. When the sheet is placed on the processing tray 48 from the post-processing conveying path 43, the leading end of the sheet is positioned at an upper end side of the processing tray 48 and the trailing end of the sheet is aligned at a lower end side of the processing tray 48.

The staple body 49 is arranged at the lower end side (a lower right side) of the processing tray 48 to execute staple processing to a binding position at a rear end of the sheet. Moreover, the staple body 49 can be moved with regard to the processing tray 48 by the moving mechanism 50, for example, can be moved in the orthogonal direction (forward and backward directions) to the conveying direction, that is in the width direction of the sheet. The staple body 49 can change the binding position in the width direction by moving in the width direction of the sheet.

Moreover, the staple body 49 is configured so as to move in the conveying direction of the sheet with regard to the processing tray 48, or so as to adjust an aligning position of the trailing end of the sheet on the processing tray 48 with regard to the staple body 49, and thereby, can change the binding position in the conveying direction of the sheet, that is, in the length direction of the sheet.

The moving mechanism 50 is composed of, for example, a rail 50 extended in the width direction of the sheet and a driving part 52 driving in the width direction on the rail 51, and the staple body 49 is supported by the driving part 52. The driving part 52 is controlled by the controlling part 60 of the post-processing device 3 to drive on the rail 51, and thereby, moves the staple body 49 to the binding position. Moreover, the driving part 52 supports the staple body 49 turnably, is controlled by the controlling part 60 of the post-processing device 3 to turn the staple body 49, and thereby, can change a binding angle to the sheet.

The pair of sheet ejecting rollers 47 are arranged at the upper end side of the processing tray 48 and eject the sheets placed on the processing tray 48 one by one or for each one bundle of the predetermined number of sheets. The pair of sheet ejecting rollers 47 are configured, for example, so as to make one sheet ejecting roller 47 separate from or contact with the other sheet ejecting roller 47. When placing the sheet on the processing tray 48, one sheet ejecting roller 47 is separated from the other sheet ejecting roller 47, but when ejecting the sheet placed on the processing tray 48, one sheet ejecting roller 47 comes into contact with the other sheet ejecting roller 47 so as to sandwich the sheet in between.

Figure 4:
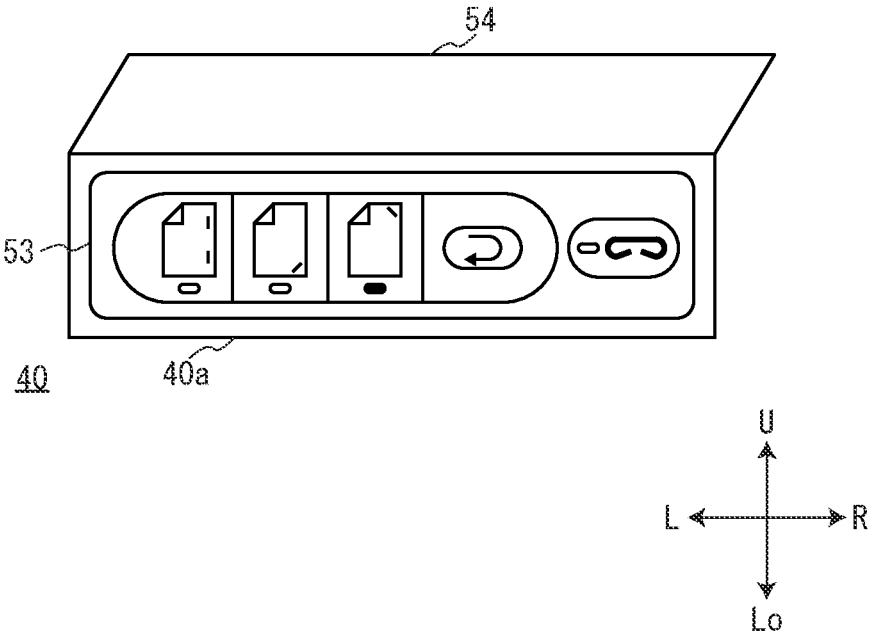
FIG. 4 is a front view showing an operation part and its peripheral parts of a post-processing device according to the embodiment of the present disclosure.

Further, on a front face of the device body 40, as shown in FIG. 4, an operation part 53 and an operation cover 54 are attached. The operation part 53 includes various operation keys, such as a staple executing key, for manually manipulating the post-processing device 3 in a recessed part 40*a* on the front face of the device body 40. The operation cover 54 is constituted capable of opening/closing the recessed part 40*a* on the front face of the device body 40 so as to expose or house the various operation keys of the operation part 53.

Electric structure of the post-processing device 3 will be described with reference to FIG. 2. The post-processing device 3 includes a controlling part 60 composed of a central processing unit (CPU) or the like, and a storing part 61 composed of a ROM, a RAM and others, inside the device body 40.

The controlling part 60 controls each component connected to the controlling part 60 on the basis of control program and control data stored in the storing part 61. For example, the controlling part 60 is connected to each component of the post-processing device 3, such as the punching part 45, the stapling part 46 (the staple body 49, the moving mechanism 50), the pair of sheet ejecting rollers 47, the operation part 53 and a driving source (not shown) for each conveying roller.

In addition, the controlling part 60 is connected to a communicating part 62 as an interface communicating with an external device. When the communicating part 62 is connected with the multifunction peripheral 2, the multifunction peripheral 2 and the post-processing device 3 become possible to communicate with each other. For example, when the multifunction peripheral 2 starts the image forming operation, the controlling part 60 receives the post-processing instruction (e.g. punch processing instruction or staple processing instruction) to the sheet after the image forming operation via the communicating part 62.

The controlling part 60 executes the program stored in the storing part 61 to work as a size deciding part 63 deciding the sheet size and a staple controlling part 64 controlling staple processing of the stapling part 46. Executing operation of staple processing of the stapling part 46 in the post-processing device 3 will be described with reference to a flowchart in FIG. 3.

First, the post-processing device 3 receives the staple processing instruction, that contains information of the number of binding set by the multifunction peripheral 2 and the image data created by the image scanner 25 in the image forming operation in the multifunction peripheral 2, from the multifunction peripheral 2 via the communicating part 62 (step S7). The staple controlling part 64 controls the stapling part 46 to make the stapling part 46 execute staple processing in a case where the staple processing instruction indicates on of staple processing.

The size deciding part 63 decides the sheet size of the sheet as an object of post-processing. In a case where the staple processing instruction contains information of the regular size, the size deciding part 63 decides that the sheet size is the regular size. Incidentally, in staple processing, in a case where the sheet size is the regular size, the binding position of the sheet may be previously determined while being associated with the sheet size and the number of binding and be stored in the storing part 61. Therefore, the staple controlling part 64 reads out the previously determined binding position in a case where of obtaining information of the sheet size being the regular size.

On the other hand, in a case where the sheet size is the irregular size, it is difficult to previously determine the binding position of the sheet. Therefore, the size deciding part 63 decides an irregular sheet size on the basis of the image data of the sheet (step S8). Concretely, the size deciding part 63 calculates a profile of an effective area indicating the sheet from the image data and calculates a length and a width (a dimension) of the sheet as the sheet size in accordance with the profile.

Moreover, the staple controlling part 64 decides the binding position of the sheet directed to staple processing on the basis of the sheet size and the number of binding (step S9). The staple controlling part 64 set the binding position in the length direction to an inside position in proportion to the length of the sheet regardless of the number of binding.

Figure 5:
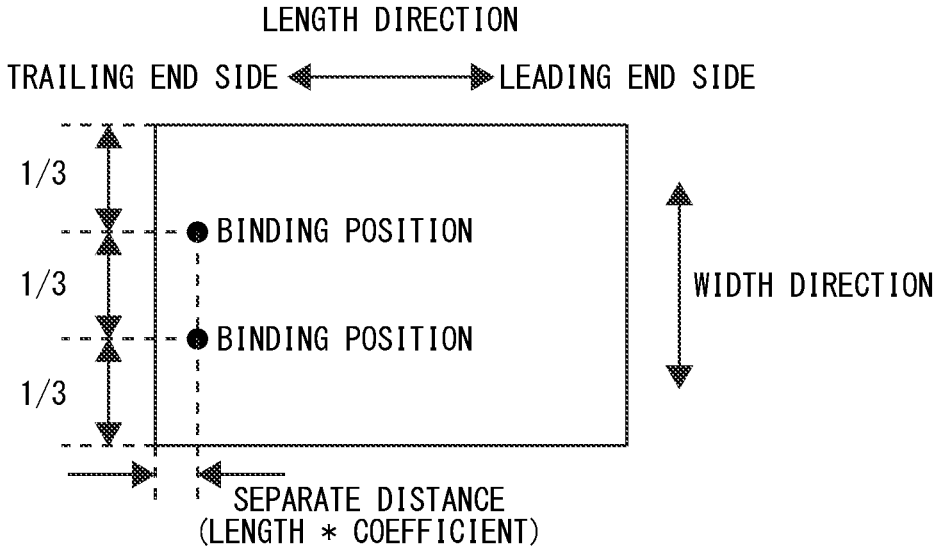
FIG. 5 is an explanatory drawing showing a sheet directed to staple processing with binding positions in the image forming system according to the embodiment of the present disclosure.

For example, as shown in FIG. 5, the staple controlling part 64 calculates a separate distance by multiplying the length of the sheet by a predetermined coefficient and sets the binding position in the length direction to a position separated inwardly from the trailing end of the sheet by the separate distance. Incidentally, in FIG. 5, the binding position shows a center of a staple.

Moreover, about the binding position in the width direction, in a case where the number of binding is larger than 2, the staple controlling part 64 set binding positions in the width direction at equal intervals. Incidentally, a calculating mode of the binding position in the width direction in a case of the number of binding is larger than 2 may be selectable according to operation of the user via the operation display part 27 or the operation part 53.

In a normal mode of the binding position in the width direction, the staple controlling part 64 calculates each binding position in the width direction by dividing the width of the sheet into equal portions of the number of binding plus 1. For example, as shown in FIG. 5, in a case where the number of binding is 2, the staple controlling part 64 calculates two binding positions by dividing the width of the sheet at an interval of one third.

Alternatively, in both ends fixing mode of the binding position in the width direction, the staple controlling part 64 sets binding positions at both end sides in the width direction to fixed positions. In such a case, respective distances from both ends of the sheet in the width direction to the binding positions at both end sides may be previously set or may be set according to operation of the user via the operation display part 27 or the operation part 53. Subsequently, the staple controlling part 64 calculates a remaining binding position in the width direction by dividing the width between the binding positions at both end sides of the sheet into equal portions of the number of binding minus 1.

Further, about the binding position in the width direction, in a case where the number of binding is 1, the staple controlling part 64 may allow the user to select any one out of both end sides and the center of the sheet in the width direction in accordance with operation of the user via the operation display part 27 or the operation part 53. Here, in a case where any one of both end sides of the sheet in the width direction, the staple controlling part 64 may set the binding position in the width direction to an inside position in proportion to the width of the sheet, for example, calculate the separate distance by multiplying the width of the sheet by a predetermined coefficient and set the binding position in the width direction to a position separated inwardly from an end of the sheet by the separate distance.

Incidentally, the staple controlling part 64 may create an image data indicating the sheet and the binding position on the basis of the sheet size and the biding position decided as described above, transmits this image data to the multifunction peripheral 2 via the communicating part 62 and make the operation display part 27 of the multifunction peripheral 2 display a preview of this image data.

Subsequently, the staple controlling part 64 controls the moving mechanism 50 to move the staple body 49 to the binding position decided as described above and executes staple processing to the sheet on the processing tray 48 (step S10). The staple controlling part 64 repeats staple processing if there is unprocessed binding position (step S11: Yes), but finishes staple processing if there is no unprocessed binding position (step S11: No).

Incidentally, although, in the above-described embodiment, an example that the multifunction peripheral 2 transmits the image data of the sheet to the post-processing device 3 and the size deciding part 63 of the post-processing device 3 decides the sheet size on the basis of the image data is described, the present disclosure is not limited by this example. For example, in another embodiment of the disclosure, the controlling part 30 of the multifunction peripheral 2 may work the size deciding part 63 deciding sheet size by executing a program stored in the storing part 31 to decide the sheet size on the basis of the image data and to transmit the sheet size of a decided result to the post-processing device 3 via the communicating part 32.

Moreover, although, in the above-described embodiment, an example that the staple processing part 64 applies the previously determined binding position of the sheet in a case where the sheet size is the regular size is described, the present disclosure is not limited by this example. For example, in another embodiment of the disclosure, the staple processing part 64 may determine the binding position of the sheet on the basis of the sheet size similar to a case of the irregular size.

Although, in the above-described embodiment, an example that the sheet to the post-processing device 3 executes staple processing to the trailing end of the sheet while aligning trailing ends of the sheets at the lower end side of the processing tray 48 is described, the present disclosure is not limited by this example. For example, in another embodiment of the disclosure, the post-processing device 3 may be configured to convey the sheet so as to align leading ends, right ends or left ends of the sheets at the lower end side of the processing tray 48 and to execute staple processing to the leading end, the right end or the left end of the sheet.

Moreover, although, in the above-described embodiment, an example that the multifunction peripheral 2 ejects the sheet having the image fixed by the fixing part 23 from the multifunction peripheral sheet ejecting part 24 and feeds the sheet to the post-processing device 3 through the relay unit 13 is described, the present disclosure is not limited by this example. For example, in another embodiment of the disclosure, the multifunction peripheral 2 may be configured to arrange the multifunction peripheral sheet ejecting part 24 at a position corresponding to the post-processing sheet feeding part 41 of the post-processing device 3, and then, to eject the sheet having the image fixed by the fixing part 23 from the multifunction peripheral sheet ejecting part 24 and feeds the sheet to the post-processing device 3 directly.

Further, although, in the above-described embodiment, an example that the image scanner 25 is arranged between the fixing part 23 and the multifunction peripheral sheet ejecting part 24 so as to obtain the image data by reading the sheet conveyed from the fixing part 23 to the multifunction peripheral sheet ejecting part 24 is described, the present disclosure is not limited by this example. For example, in another embodiment of the disclosure, the image scanner 25 may be provided in the relay unit 13 so as to obtain the image data by reading the sheet conveyed to the relay sheet ejecting part 13*b* of the relay unit 13.

In accordance with the embodiment, as described above, the image forming system 1 includes the multifunction peripheral 2 as the image forming apparatus forming the image on the sheet, and the post-processing device 3 executing post-processing to the sheet having the image formed by the multifunction peripheral 2. The multifunction peripheral 2 includes the image scanner 25 (scanner), the image forming part 17, and the multifunction peripheral sheet ejecting part 24 (sheet ejecting part) or the relay sheet ejecting part 13*b* (sheet ejecting part). The image scanner 25 obtains the image data by reading the sheet. The image forming part 17 forms the image on the sheet. The multifunction peripheral sheet ejecting part 24 or the relay sheet ejecting part 13*b* ejects the sheet having the image formed by the image forming part 17. The post-processing device 3 includes the post-processing conveying path 43 and the stapling part 46. The post-processing conveying path 43 introduces the sheet ejected from the multifunction peripheral sheet ejecting part 24 or the relay sheet ejecting part 13*b* and conveys the sheet. The stapling part 46 collects the sheets conveyed on the post-processing conveying path 43 for each predetermined number of sheets and executes staple processing to the sheets. The multifunction peripheral 2 or the post-processing device 3 further includes the size deciding part 63 deciding the sheet size on the basis of the image data obtained by the image scanner 25. The post-processing device 3 further includes the staple controlling part 64 determining the binding position of the sheet directed to staple processing on the basis of the sheet size decided by the size deciding part 63.

Thereby, in a case of executing post-processing to the sheet of the irregular size, without depending on operation of the user, it is possible to appropriately grasp the dimension of the sheet of the irregular size. Moreover, since it is possible to grasp the appropriate binding position of the sheet of the irregular size, it is possible to execute staple processing at the appropriate binding position.

For example, in the image forming system 1, the multifunction peripheral 2 further includes the operation display part 27 receiving operation of the user. The staple controlling part 64 receives input of the previously determined number of binding or the number of binding set by the operation display part 27. Moreover, the staple controlling part 64 decides the length in the conveying direction (length direction) of the sheet and the width in the orthogonal direction (width direction) to the conveying direction, that is, the dimension of the sheet, as the sheet size on the basis of the image data. Subsequently, the staple controlling part 64 calculates the binding position in at least one direction of the length direction and the width direction of the sheet directed to staple processing on the basis of at least one of the length and the width of the sheet and the number of binding. Thereby, it is possible to determine the appropriate binding position regardless of a degree and a proportion of the length and the width of the sheet and the number of binding.

Moreover, in the image forming system 1, the multifunction peripheral 2 further includes the fixing part 23 fixing the image formed by the image forming part 17 on the sheet. The image scanner 25 may be arranged between the fixing part 23 and the multifunction peripheral sheet ejecting part 24 or the relay sheet ejecting part 13*b* to obtain the image data by reading the sheet conveyed from the fixing part 23 to the multifunction peripheral sheet ejecting part 24 or the relay sheet ejecting part 13*b*. Thereby, even if the sheet is slightly deformed and varied by being heated by the fixing part 23, it is possible to appropriately grasp the sheet size of the sheet treated in the post-processing device 3.

Figure 6:
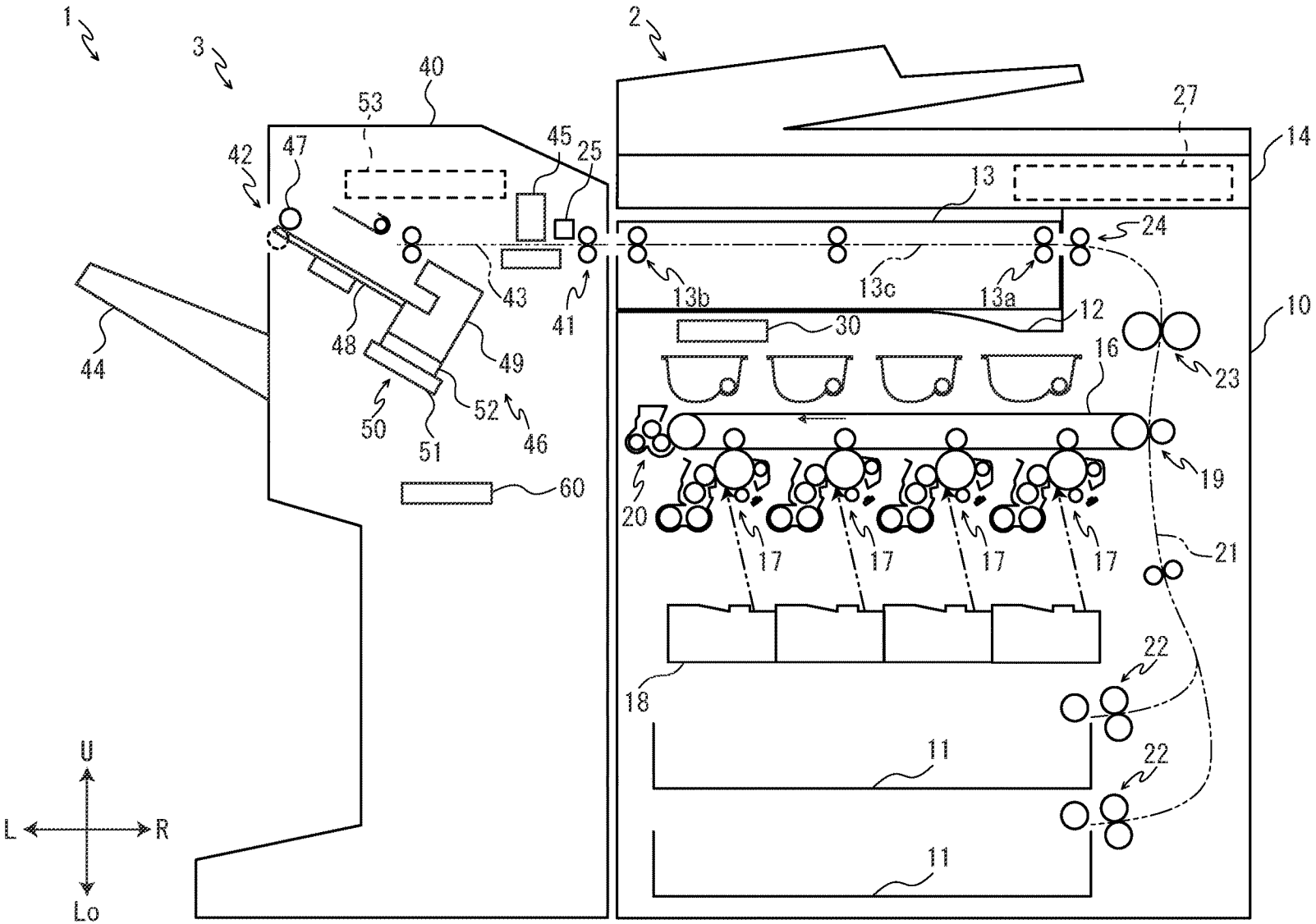
FIG. 6 is a sectional view schematically showing an image forming system according to another embodiment of the present disclosure.

Incidentally, although, in the above-described embodiment, an example that the image scanner 25 is provided in the multifunction peripheral 2 is described, the present disclosure is not limited by this example. For example, in another embodiment of the disclosure, as shown in FIG. 6, the image scanner 25 may be provided in the post-processing device 3. In such a case, the image scanner 25 is arranged at an upstream side from the stapling part 46 in the conveying direction of the sheet in the post-processing device 3 and in the vicinity of the post-processing conveying path 43. Subsequently, the image scanner 25 obtains the image data by reading the sheet conveyed on the post-processing conveying path 43 and outputs the image data to the controlling part 60.

Moreover, similar to the above-described embodiment, the post-processing device 3 may receive input of the number of binding from the staple processing instruction received from the multifunction peripheral 2 via the communicating part 62, or may receive input of the number of binding previously determined in the post-processing device 3 and stored in the storing part 61 or the number of binding the number of binding set by the user via the operation part 53. Incidentally, a method of calculating the binding position by the staple controlling part 64 is similar to the above-described embodiment.

The above-description of the embodiment of the present disclosure was described about a preferable embodiment of the post-processing device and the image forming system according to the disclosure. However, the technical scope of the present disclosure is not limited to the embodiments.

Although the above-described embodiments have described about a case applying the configuration of the present disclosure to the post-processing device 3 introducing the sheet from the multifunction peripheral 2 or the image forming system 1 including the multifunction peripheral 2 and the post-processing device 3, in a further different embodiment, the configuration of the present disclosure may be applied to another post-processing device introducing the sheet from another image forming apparatus or another image forming system including another image forming apparatus.

The invention claimed is:

1. An image forming system comprising:

an image forming apparatus forming an image on a sheet; and a post-processing device executing post-processing to the sheet having the image formed by the image forming apparatus, wherein the image forming apparatus includes:

a scanner obtaining image data by reading the sheet;

an image forming part forming the image on the sheet; and a sheet ejecting part ejecting the sheet having the image formed by the image forming part, the post-processing device includes:

a post-processing conveying path introducing the sheet ejected from the sheet ejecting part and conveying the sheet; and a stapling part collecting sheets conveyed on the post-processing conveying path for each predetermined number of sheets and executing staple processing to the sheets, the image forming apparatus or the post-processing device further includes a size deciding part deciding whether the sheet is a regular size or an irregular size, and, if the sheet is the irregular size, deciding a sheet size of the sheet on the basis of the image data obtained by the scanner, the post-processing device further includes a staple controlling part determining, if the sheet is the regular size, a binding position of the sheet directed to the staple processing by a previously determined binding position, and, on the other hand, determining, if the sheet is the irregular size, the binding position of the sheet directed to the staple processing on the basis of the sheet size decided by the size deciding part.

2. The image forming system according to claim 1, wherein the staple controlling part decides, if the sheet is the irregular size, a length in a conveying direction of the sheet as the sheet size on the basis of the image data, and calculates the binding position in a length direction of the sheet directed to the staple processing on the basis of the length of the sheet and the previously determined number of binding or the number of binding set by an operation part receiving operation of a user.

3. The image forming system according to claim 1, wherein the staple controlling part decides, if the sheet is the irregular size, a width in a orthogonal direction to a conveying direction of the sheet as the sheet size on the basis of the image data, and calculates the binding position in a width direction of the sheet directed to the staple processing on the basis of the width of the sheet and the previously determined number of binding or the number of binding set by an operation part receiving operation of a user.

4. The image forming system according to claim 3, wherein the staple controlling part, in a normal mode of the binding position in the width direction, calculates a binding position in the width direction by dividing the width of the sheet into equal portions of the number of binding plus 1, and in both ends fixing mode of the binding position in the width direction, sets binding positions at both end sides in the width direction to fixed positions, and calculates a remaining binding position in the width direction by dividing the width between the binding positions of both end sides of the sheet into equal portions of the number of binding minus 1.

5. The image forming system according to claim 3, wherein the staple controlling part, in a case where the number of binding is 1, allows the user to select the biding position in the width direction in accordance with operation of the user.

6. The image forming system according to claim 1, wherein the staple controlling part creates image data indicating the sheet and the binding position and makes the image forming apparatus display a preview of this image data.

7. The image forming system according to claim 3, wherein the image forming apparatus further includes:

a fixing part fixing the image formed by the image forming part on the sheet, the scanner is arranged between the fixing part and the sheet ejecting part to obtain the image data by reading the sheet conveyed from the fixing part to the sheet ejecting part.

8. A post-processing device comprising:

a post-processing conveying path conveying a sheet, on which an image is formed, from an image forming apparatus;

a stapling part collecting sheets conveyed on the post-processing conveying path for each predetermined number of sheets and executing staple processing to the sheets;

a scanner arranged at an upstream side from the stapling part in a conveying direction of the sheet and obtaining image data by reading the sheet conveyed on the post-processing conveying path;

a size deciding part deciding whether the sheet is a regular size or an irregular size, and, if the sheet is the irregular size, deciding a sheet size of the sheet on the basis of the image data; and a staple controlling part determining, if the sheet is the regular size, a binding position of the sheet directed to the staple processing by a previously determined binding position, and, on the other hand, determining, if the sheet is the irregular size, the binding position of the sheet directed to the staple processing on the basis of the sheet size decided by the size deciding part.

9. The post-processing device according to claim 8, wherein the staple controlling part decides, if the sheet is the irregular size, a length in a conveying direction of the sheet as the sheet size on the basis of the image data, and calculates the binding position in a length direction of the sheet directed to the staple processing on the basis of the length of the sheet and the previously determined number of binding or the number of binding set by an operation part receiving operation of a user.

10. The post-processing device according to claim 8, wherein the staple controlling part decides, if the sheet is the irregular size, a width in a orthogonal direction to a conveying direction of the sheet as the sheet size on the basis of the image data, and calculates the binding position in a width direction of the sheet directed to the staple processing on the basis of the width of the sheet and the previously determined number of binding or the number of binding set by an operation part receiving operation of a user.

11. The post-processing device according to claim 10, wherein the staple controlling part, in a normal mode of the binding position in the width direction, calculates a binding position in the width direction by dividing the width of the sheet into equal portions of the number of binding plus 1, and in both ends fixing mode of the binding position in the width direction, sets binding positions at both end sides in the width direction to fixed positions, and calculates a remaining binding position in the width direction by dividing the width between the binding positions of both end sides of the sheet into equal portions of the number of binding minus 1.

12. The post-processing device according to claim 10, wherein the staple controlling part, in a case where the number of binding is 1, allows the user to select the biding position in the width direction in accordance with operation of the user.

13. The post-processing device according to claim 10, wherein the staple controlling part creates image data indicating the sheet and the binding position and makes the image forming apparatus display a preview of this image data.

* * * * *